US010047540B2

(12) United States Patent
Charnley et al.

(10) Patent No.: US 10,047,540 B2
(45) Date of Patent: Aug. 14, 2018

(54) LOCKING DEVICE

(71) Applicant: Henry Squire & Sons Ltd, Wolverhampton (GB)

(72) Inventors: John Charnley, Newcastle upon Tyne (GB); Clinton Sheppard, Idaho Falls, ID (US); Glyn Green, Cannock (GB)

(73) Assignee: HENRY SQUIRE & SONS LTD (GB)

( * ) Notice: Subject to any disclaimer, the term of this patent is extended or adjusted under 35 U.S.C. 154(b) by 0 days.

(21) Appl. No.: 14/802,082

(22) Filed: Jul. 17, 2015

(65) Prior Publication Data

US 2016/0017636 A1 Jan. 21, 2016

(30) Foreign Application Priority Data

Jul. 17, 2014 (GB) ..... 1412734.4

(51) Int. Cl.

| | |
|---|---|
| ***E05B 27/00*** | (2006.01) |
| ***E05B 47/00*** | (2006.01) |
| ***E05B 47/06*** | (2006.01) |
| ***E05B 19/26*** | (2006.01) |
| ***E05B 49/00*** | (2006.01) |

(52) U.S. Cl.

CPC ..... *E05B 27/0003* (2013.01); *E05B 19/26* (2013.01); *E05B 47/0002* (2013.01); *E05B 47/0038* (2013.01); *E05B 47/0044* (2013.01); *E05B 47/063* (2013.01); *E05B 49/00* (2013.01);

(Continued)

(58) Field of Classification Search

CPC .. E05B 47/0009; E05B 47/063; E05B 51/005; Y10S 292/66; Y10T 70/7667; Y10T 70/20; Y10T 70/713; Y10T 70/7684; Y10T 70/7079; Y10T 70/7119; Y10T 70/7616

USPC ..... 70/278.1–278.3, 278.7, 280–283.1, 277, 70/276, 413

See application file for complete search history.

(56) References Cited

U.S. PATENT DOCUMENTS 3,657,907 A * 4/1972 Boving ..... E05B 47/0041 70/276
3,665,740 A * 5/1972 Taniyama ..... E05B 47/0044 70/276

(Continued)

FOREIGN PATENT DOCUMENTS

DE 4324711 1/1995
DE 19639545 12/1997

(Continued)

OTHER PUBLICATIONS

Corresponding Search and Examination report by the UK Patent Office for GB1412734.4 dated Dec. 17, 2014.

*Primary Examiner* — Suzanne L Barrett
(74) *Attorney, Agent, or Firm* — The Belles Group, P.C.

(57) ABSTRACT

A locking device and system are disclosed. The locking device includes a barrel within which sets a plug. A plurality of pins sit in pin pathways that extend partially through the barrel and plug and the pins prevent rotation of the barrel within the plug when the ends of the pins are not aligned with a shear line. One of the pins has a recess formed therein within which a locking ball can sit. The engagement or otherwise of the locking ball in the recess is controlled by a linear actuator. When the linear actuator allows the locking ball to disengage the recess the pin with the recess in can engage the key and a line the end of the pin with the shear line.

16 Claims, 10 Drawing Sheets

(52) U.S. Cl.
CPC ..... *E05B 2047/0067* (2013.01); *E05B 2047/0072* (2013.01)

(56) References Cited

U.S. PATENT DOCUMENTS 3,705,369 A * 12/1972 Schwendeman, Jr. . H01H 27/06 200/61.66
3,837,194 A * 9/1974 Fish ..... E05B 47/0044 70/276
3,837,195 A * 9/1974 Pelto ..... E05B 47/0038 70/276
4,228,667 A * 10/1980 Herriott ..... E05B 47/0044 70/276
4,392,134 A * 7/1983 Lutz ..... C03C 3/064 340/5.22
4,416,127 A * 11/1983 Gomez-Olea Naveda ..... G07C 9/0073 70/276
4,712,398 A 12/1987 Clarkson et al.
4,748,834 A * 6/1988 Herriott ..... E05B 47/0038 335/306
4,788,623 A * 11/1988 Haug ..... G07C 9/0073 335/206
4,807,454 A 2/1989 Sengupta et al.
4,841,758 A * 6/1989 Ramblier ..... E05B 47/0044 70/276
5,193,371 A * 3/1993 Yamane ..... E05B 47/0043 70/276
5,442,986 A 8/1995 Cota
6,041,631 A * 3/2000 Vonlanthen ..... E05B 29/00 70/413
6,367,297 B1 * 4/2002 Mottura ..... E05B 47/0044 70/276
6,705,139 B2 * 3/2004 Tsai ..... E05B 47/0044 70/276
8,312,749 B2 * 11/2012 Tong ..... E05B 27/00 70/367
2013/0152646 A1 6/2013 Field

FOREIGN PATENT DOCUMENTS

| | | |
|---|---|---|
| DE | 202004009425 U | 10/2004 |
| EP | 0668422 | 8/1998 |
| EP | 1626142 | 2/2006 |
| EP | 2476824 | 7/2012 |
| FR | 2808552 | 11/2001 |
| WO | 9836142 | 8/1998 |
| WO | 2013044905 | 4/2013 |

* cited by examiner

LOCKING DEVICE

CROSS-REFERENCE TO RELATED APPLICATIONS

This application claims priority under 35 U.S.C. § 119 to United Kingdom Patent Application No. 1412734.4, filed Jul. 17, 2014, the entirety of which is hereby incorporated herein by reference.

FIELD OF THE INVENTION

The present invention relates to a locking device and relates particularly, but not exclusively, to an electronic and mechanical locking device for use replacing a standard cylinder lock.

BACKGROUND OF THE INVENTION

Electronically encoding a digital password into a key is a well-known technique for enhancing the security of a mechanical locking device. However, such electronic security requires electrical power which must be supplied to both the key and the cylinder. The electronic components in the cylinder lock generally control a solenoid and significantly more power is required to activate this solenoid than is needed to power the key. As a result, the batteries that are needed for the cylinder are either prone to a short life or must be larger than is generally desirable. Since the power supply for the locking system is generally held in the key, which are carried by a person who will use the lock, this results in an undesirably large key.

Electronic locking mechanisms commonly use either linear or rotary actuators to complete the final element of the unlocking process once a code on a key has been matched with the code held on the lock. When a design relies upon power being delivered to a linear actuator power needs to be supplied for a considerable amount of time, often several seconds to ensure the lock remains unlocked until the key is turned. Where a design uses a rotary actuator some means has to be provided to cause the actuator to rotate in the opposite direction in order to relock once the key has been removed (which also removes the power supply). Unless there are sensors in the lock there is no way of knowing if the rotary actuator has properly reset. This is a fundamental weakness in some electronic locks. When they sense that the key has been removed, energy stored in on board capacitors (charged from the key) drives a tiny motor. However, many such locks have no sensors so have no way of knowing if the lock has reset. The only way of telling is to insert a correct mechanical key without electronics. If it still unlocks, the lock has not properly reset. An alternative to this is to use a separate feature on the key to cause a reset during key removal. However, removal of the feature means the reset will not work and any key will then open the lock.

In mechanical locks it is known to use magnets to control the locking process. However, locating a magnet on a key is undesirable as the magnet may affect close by located objects such as the magnetic strips on machine-readable cards such as credit cards. Furthermore, the magnet will attract small and microscopic pieces of ferromagnetic material which may then be dislodged from the key in a lock mechanism potentially resulting in fouling of the mechanism.

BRIEF SUMMARY OF THE INVENTION

Preferred embodiments of the present invention seek to overcome the above described disadvantages of the prior art.

According to an aspect of the present invention there is provided a locking device comprising: at least one barrel; at least one respective plug rotatable around an axis within said barrel; a plurality of pin pathways extending partially through said barrel and said plug at an angle transverse to said axis, the pin pathways forming a shear line where each pin pathway intersects a junction between the plug and barrel; a plurality of pins, slidable within said pin pathways, such that when an end of each pin is aligned with the shear line, the plug is able to rotate within the barrel, wherein at least one said pin has a recess therein; at least one locking member adapted to engage said recess; and at least one locking member control device adapted to move between a first condition in which said locking member is held in engagement with said recess thereby preventing movement of said pin and a second condition in which said locking member is released to allow movement of said locking member and said pin.

By providing a recess in one of pins, a locking member adapted to engage the recess and a locking member control device, the advantage is provided that the lock is able to operate using significantly less power than similar devices of the prior art. The locking member prevents the pin from engaging key and as a result the end of the pin does not align with the shear line and the plug cannot be rotated. When the locking member control device moves to the second condition, the pin is released, can engage the key and with the end of the pin aligned with the shear line the plug can rotate. The locking member and pin now prevent the locking member control device returning to the first condition until the removal of the key pushes them into alignment with the recess which in turn allows space for the locking member control device to extend. As a result, the locking member control device needs to only act for a very short period of time thereby significantly reducing the power consumed by the locking member control device. This in turn extends the life of the battery in the key and/or allows a much smaller battery to be used.

In a preferred embodiment the locking member control device is moved from said first condition to said second condition in response to a control signal from a control processor. In another preferred embodiment the control processor creates said control signal in response to a match between a code signal held on a key and a code held in said processor. In a further preferred embodiment the pins comprise first pin portions and second pin portions.

The locking member may comprise a locking ball. The locking member control device may comprise an electromechanical linear actuator.

In a preferred embodiment the electromechanical linear actuator comprises: a body housing a first permanent magnet; plunger including a second permanent magnet arranged to be repelled by said first permanent magnet, said plunger at least partially extending from said housing; and an electromagnet arranged to withdraw said second permanent magnet towards said first permanent magnet.

In a preferred embodiment, the locking member control device comprises a third permanent magnet and said locking member control device comprises a fourth permanent magnet located on one side of a key pathway in said plug with said locking member and locking control device located on another side of said key pathway and wherein said magnet is not sufficiently strong to move said locking control member from said first condition to said second condition when no key or a key in which a blade of the key is formed predominantly from a magnetic material is present in said key pathway but is sufficiently strong to move said locking control member from said first condition to said second condition when a key having a blade including a first blade portion formed from a nonmagnetic material and a second blade portion formed from a non-magnetised magnetic material.

By having a permanent magnet activating the locking control member and having a magnetic material embedded in a blade of the key, the advantage is provided that the magnetic material acts as a flux bridge which activates the mechanism of the present invention. This flux bridge is hidden within the key meaning that copying the shape of the key is insufficient to provide a key which will unlock the locking device. Furthermore, keys made entirely from a magnetic material, such as steel, or where the flux bridge is in the wrong place will still not allow the locking device to be unlocked. As a result, it is particularly difficult to produce a copy of a key.

According to another aspect of the present invention there is provided a locking system comprising: locking device as set out above; and a key comprising a blade for inserting to said plug and transmitter means for transmitting said code signal to said processor.

In a preferred embodiment the key comprises a power source providing power to said locking device. In another preferred embodiment a first portion of said blade, associated with said pin with said recess therein, has a cross-section having a first height and a second portion of said blade, associated with another pin and preceding said first portion in a direction in which the key is inserted into the locking device, as a cross-section having a second height, said second height being greater than said first height.

By having a bitting (one of the ridges or teeth of the key) higher than the part of the key associated with the pin with a recess, the advantage is provided that the larger bitting causes the reset of the electronic element of the lock guaranteeing that the electronic element of the lock is always reset as the key is removed. At the same time, that bitting must be present in order to align its pin with the shear line. As a result, if that bitting has been tampered with the key will not unlock the lock even if the electronic code is correct.

According to a further aspect of the present invention, there is provided a key comprising a blade and a handle, the blade including a first blade portion formed from a nonmagnetic material and a second blade portion formed from a non-magnetised magnetic material.

According to an aspect of the present invention there is provided a locking system comprising: a locking device having at least one barrel, at least one respective plug rotatable around an axis within said barrel, a plurality of pin pathways extending partially through said barrel and said plug at an angle transverse to said axis, the pin pathways forming a shear line where each pin pathway intersects a junction between the plug and barrel, a plurality of pins, slidable within said pin pathways, such that when an end of each pin is aligned with the shear line, the plug is able to rotate within the barrel, wherein at least one said pin has a recess therein, at least one locking member adapted to engage said recess, and at least one locking member control device adapted to move between a first condition in which said locking member is held in engagement with said recess thereby preventing movement of said pin and a second condition in which said locking member is released to allow movement of said locking member and said pin; and a key comprising a blade and a handle, the blade including a first blade portion formed from a nonmagnetic material and a second blade portion formed from a non-magnetised magnetic material.

According to a further aspect of the present invention there is provided a locking device comprising: at least one barrel; at least one respective plug rotatable around an axis within said barrel; a plurality of pin pathways extending partially through said barrel and said plug at an angle transverse to said axis, the pin pathways forming a shear line where each pin pathway intersects a junction between the plug and barrel; a plurality of pins, slidable within said pin pathways, such that when an end of each pin is aligned with the shear line, the plug is able to rotate within the barrel; at least one locking member control device adapted to move between a first condition in which said locking member control device prevents movement of a pin or prevents movement of said plug in said barrel and a second condition in which said locking member control device allows movement of said pin or allows movement of said plug in said barrel, wherein said locking member control device comprises a first permanent magnet and said locking member control device comprises a second permanent magnet located on one side of a key pathway in said plug with said locking member and locking control device located on another side of said key pathway and wherein said magnets are not sufficiently strong to move said locking control member from said first condition to said second condition when no key or a key in which a blade of the key is formed predominantly from a magnetic material is present in said key pathway but is sufficiently strong to move said locking control member from said first condition to said second condition when a key having a blade including a first blade portion formed from a substantially nonmagnetic material and a second blade portion formed from a non-magnetised magnetic material is present in said key pathway.

BRIEF DESCRIPTION OF THE DRAWINGS

Preferred embodiments of the present invention will now be described, by way of example only, and not in any limitative sense with reference to the accompanying drawings in which.

DETAILED DESCRIPTION OF THE INVENTION

Figure 1:
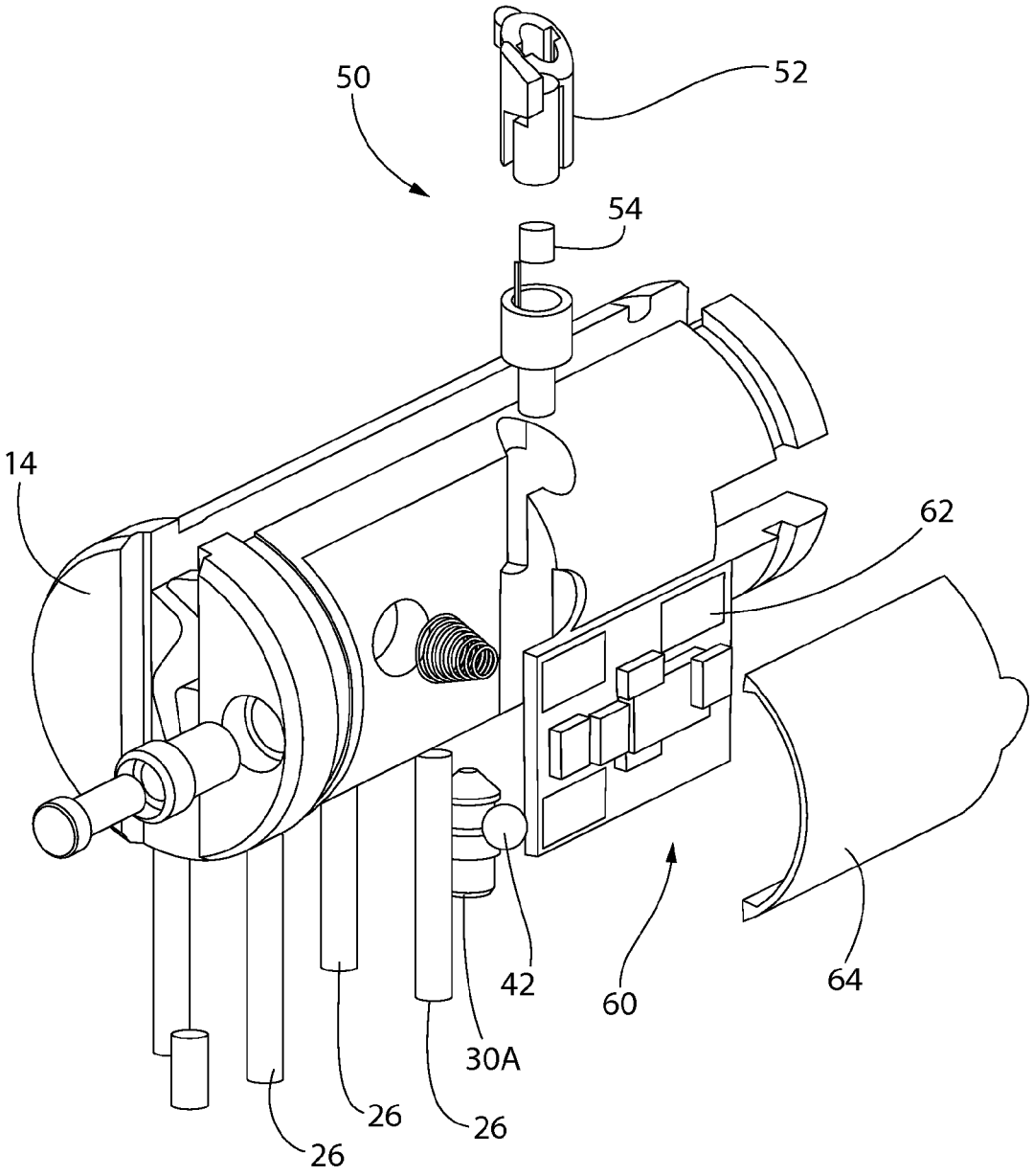
FIG. 1 is an exploded perspective view of components of the present invention.
Figure 2A:
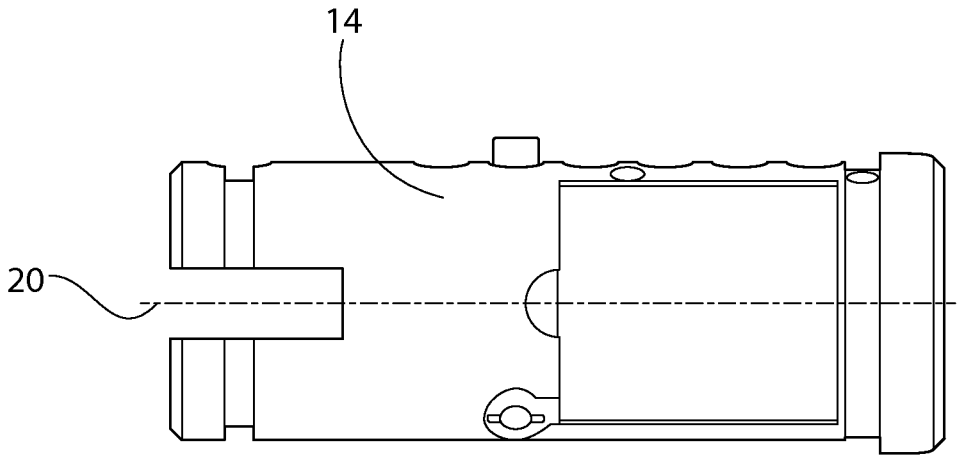
FIGS. 2A, 2B, 2C and 2D are side, plan, back, and front views of a plug used in the present invention.
Figure 2B:
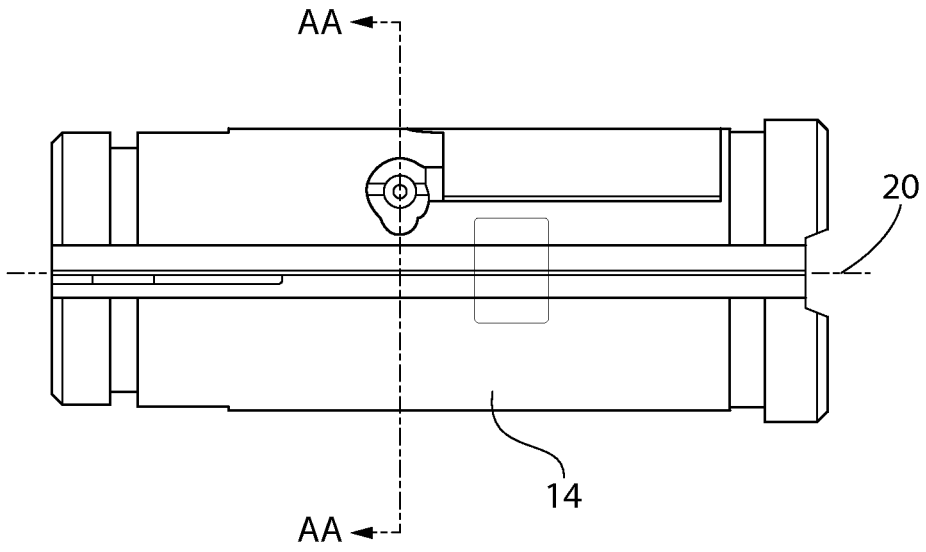
Figure 2C:
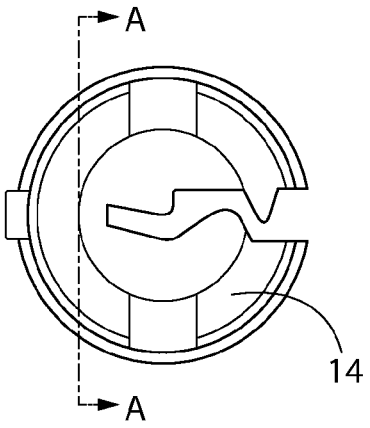
Figure 2D:
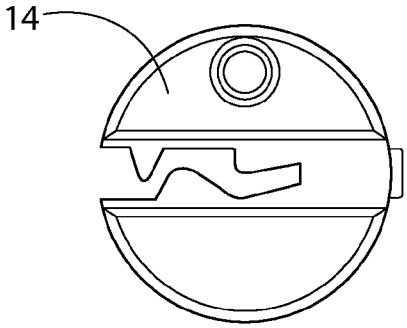
Figure 2E:
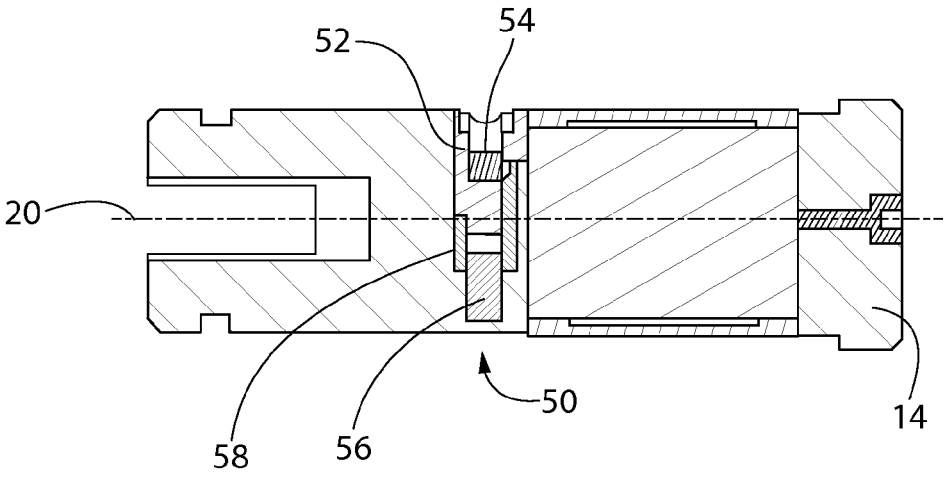
FIG. 2E is a sectional view along the line A-A of FIG. 2C.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to the figures, a locking device 10 includes a barrel 12 (see FIG. 3) and a plug 14. The barrel 12 has an annular aperture 16 within which the plug 14 is located and a body portion 18. The plug 14 is able to rotate around an axis 20 of the barrel aperture 16 and plug 14. A plurality of pin pathways 22 are formed in the plug and barrel as aperture is that when aligned form the pin pathways. The pin pathways 22 extend through the body portion 18 of the barrel at an angle that is transverse to the axis 20 and in the embodiment shown are perpendicular to the axis. The pin pathways 22 traverse the junction between the internal surface of the aperture 16 of the barrel 12 and the external surface of plug 14 and these points of intersection form the shear line, indicated at 24.

Contained within each of the pin pathways 22 is a pin. These pins can be divided into three groups as follows. Working from the outside of the lock to the inside (that is from left to right in FIG. 3) the first four pins 26 are standard pins familiar to person skilled in the art. Likewise, the innermost pin 28 is also a standard pin. The third type of pin 30 is non-standard and important to the working of the present invention. Each of the pins 26, 28 and 30 are divided into upper and lower pin portions (suffixed A and B to the reference numerals 26, 28 and 30). The upper pin portions 26A and 28A engage the key 32 when it is inserted into the lock 10 and the junction between the upper pin portions 26A and 28A and the lower pin portions 26B and 28B align with the shear line 24 when these pins engage the key. As explained in more detail below, the upper portion 30A also engages the key 32 (subject to the correct electronic code being provided) and the junction between the upper pin portion 30A and lower pin portion 30B is also then aligned with the shear line 24. When all of the junctions between the upper and lower pin portions are aligned with the shear line 24 the plug 14 is able to rotate within barrel 12 allowing the lock to unlock. It should be noted that when the key 32 is not inserted in the lock it is the lower pin portions 26B and 28B that intersect the shear line 24 and prevent rotation of the plug 14 within barrel 12 whereas it is the upper pin portion 30A that intersects the shear line 24.

Each of the pins 26, 28 and 30 are biased towards the axis 24 by a biasing device either in the form of a coil spring 34 or a pair of magnets 36 which are arranged so that like polls are directed towards each other thereby applying a biasing force towards the axis 24. Each of the pin pathways has a closing plug 38 which closes the end of the pathway in the barrel once the pins and springs or magnets have been inserted.

The upper portion 30A of new pin 30 differs from the other pins in that it is formed with a recess 40 therein, this recess being annular around the circumference of the pin and part circular in cross-section. The recess is sized and shaped to receive a locking member in the form of locking ball 42 which is typically a ball bearing. The locking ball 42 is located in plug 14 in an aperture 44 that extends partially into the plug 14 perpendicular to an intersecting the pin pathway 22. The aperture 44 has a working side 46 in which the locking ball 42 is located when the lock 10 is assembled and in use and a loading side 48 which is used to locate the locking ball 42 into the working side 46 during construction of the locking device and prior to insertion of the pin 30A.

Figure 4A:
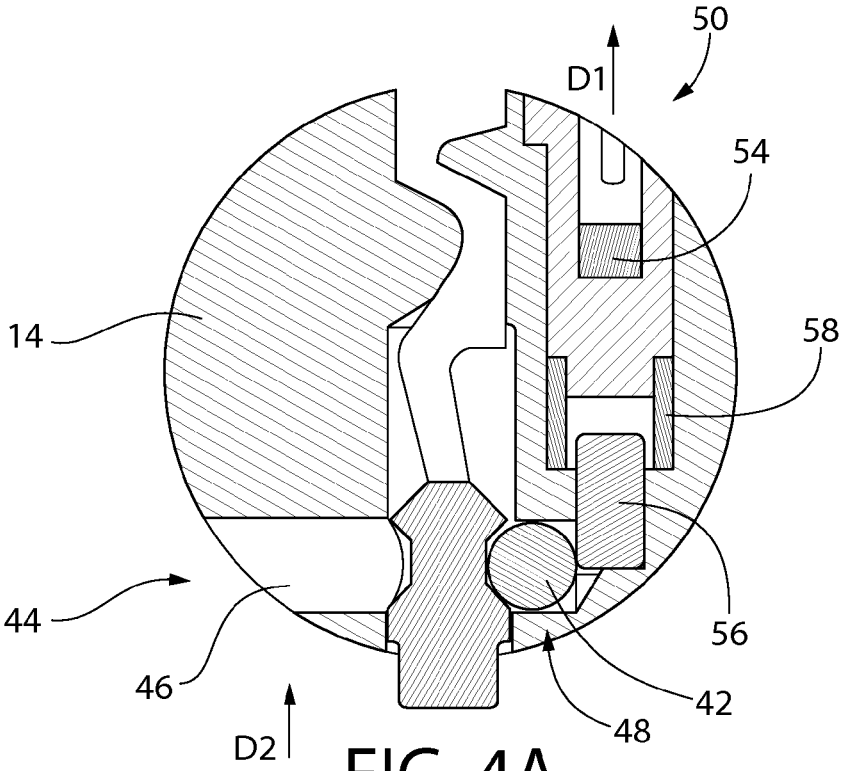
FIGS. 4A, 4B, 4C, 4D, 4E, 4F are sectional views showing the locking and unlocking of one of the pins of the device of the present invention.

Also located in plug 14 is a locking member control device in the form of electromechanical linear actuator 50 which is used to control the movement of locking member 42 and in turn the pin 30A. The linear actuator 50 includes a housing 52 within which is a fixed permanent magnet 54. A plunger 56 also forms part of the linear actuator 50 and this plunger is also formed from a permanently magnetic material. The magnet of the plunger 56 is arranged relative to the permanent magnet 54 so that like polls are adjacent each other causing the magnets to repel one another. The plunger 56 is not fixed within the housing 52 and therefore tends towards a position away from the magnet 54, as shown in FIG. 4A. The linear actuator 50 also has an electromagnet 58 which is located adjacent and preferably partially around the plunger 56. The electromagnet 58 is arranged relative to the plunger 56 such that when an electrical current is applied to the electromagnet the permanent magnet in the plunger 56 is drawn into the electromagnet towards the permanent magnet 54. The magnetic field created by the electromagnet 58 must be sufficient to overcome the magnetic repulsion between the permanent magnet 54 and the permanent magnet in the plunger 56.

Figure 5:
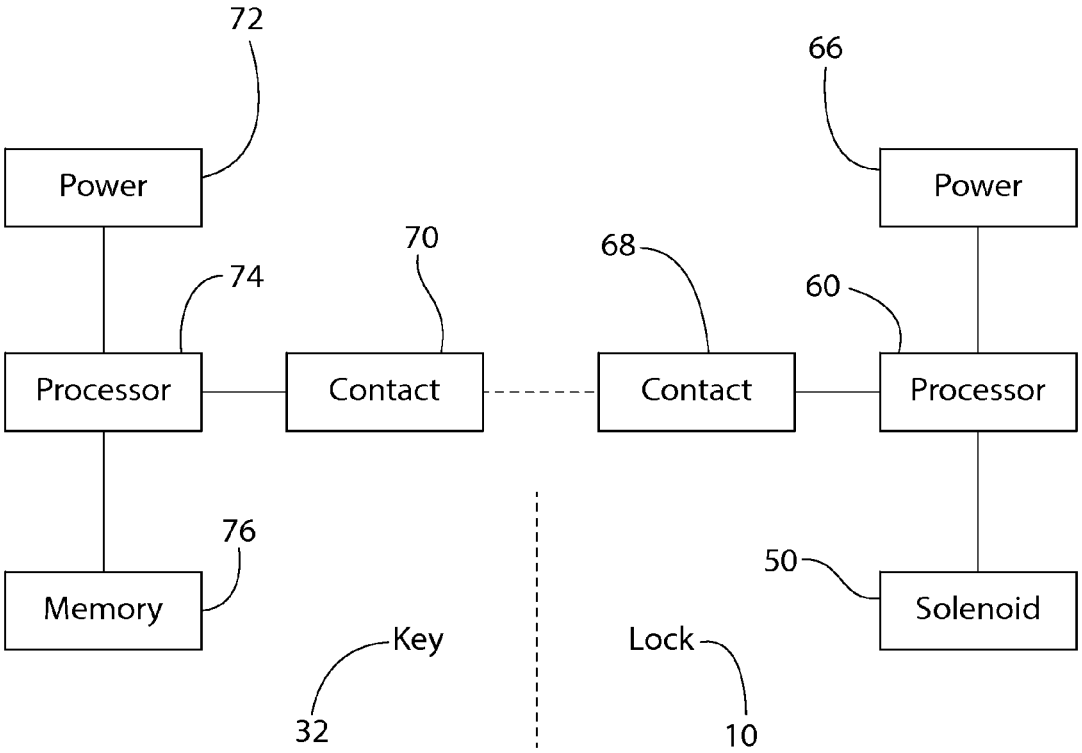
FIG. 5 is a schematic representation of the electronic components of the present invention.

Referring to FIG. 5, the linear actuator 50 operates under the control of a processor 60 which is located on a PCB 62 and is protected by a cover plate 64. Also located on PCB 62, either as part of processor 60 or separately, is a memory 66 that holds an electronic code which the processor uses to determine whether to unlock the locking device. Connected to the processor 60 is a contact 68 through which signals and power are provided from the key 32. The key 32 also has a contact 70 which engages contact 68 when the key is fully inserted into the locking device 10. Power for both the key 32 and the locking device 10 are provided by a battery 72 which is located within key 32. The key 32 also has a processor 74 and memory 76. The processor 74 passes signals to processor 60, via contacts 68 and 70, to instigate the unlocking of the electronic element of the locking device 10. The physical parts of the key are standard and include a shaft 70 into which are cut teeth 72 and notches 74. In the interest of simplicity in FIG. 3 a single notch 74 is shown although it is normally the case that a plurality of ridges and notches of varying heights would be employed in the manner seen in standard keys.

Figure 3A:
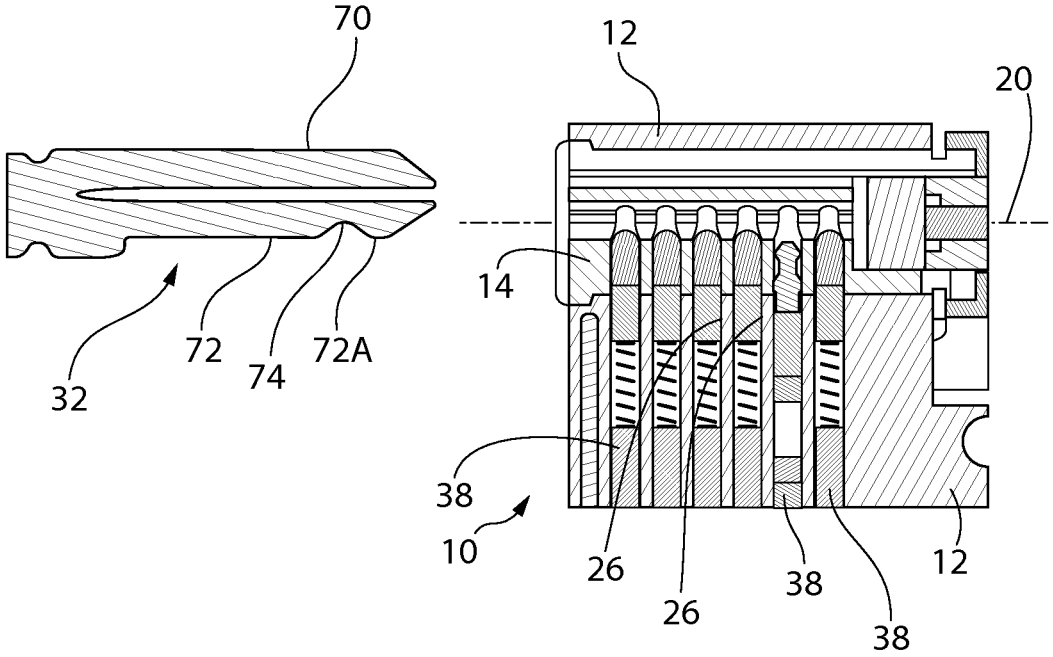
FIGS. 3A, 3B, 3C and 3D are sectional views showing the steps through the insertion and removal of the key.

The operation of locking device 10 will now be described with particular reference to FIGS. 3 and 4. FIGS. 3A and 4A show the locking device 10 in the condition before the key 32 is inserted. In this condition the lower pins 26A and 28A of pins 26 and 28 all straddle the shear line 24 as does the upper portion 30A of pin 30. As a result, the plug 14 is unable to rotate within barrel 12 and the locking device 10 cannot be unlocked.

Figure 3B:
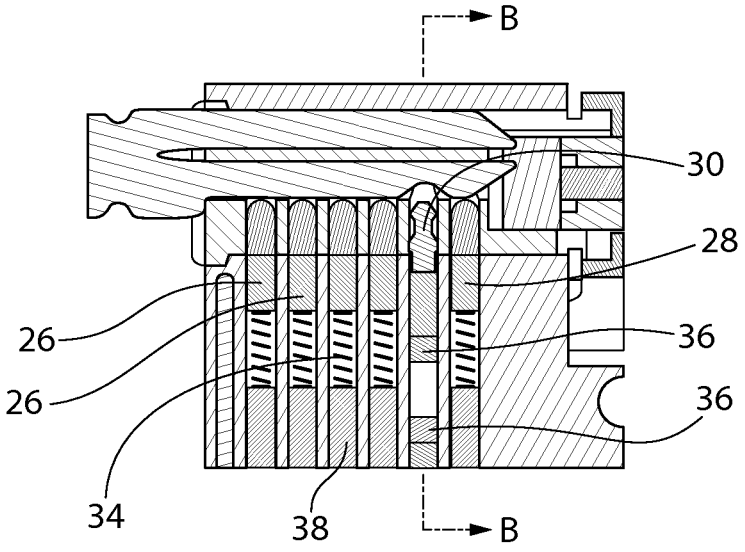
Figure 3C:
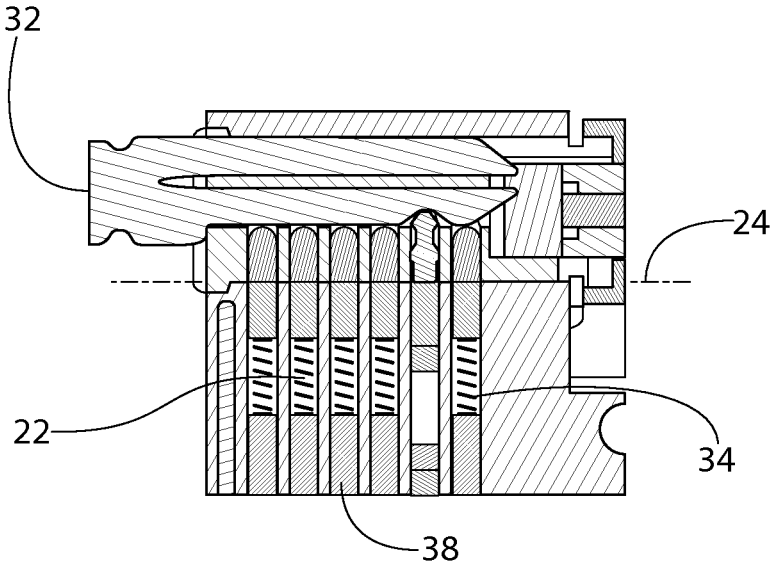

FIG. 3B shows the key 32 inserted into the plug 14 and as a result the upper portions 26A and 28A of outer and inner pins 26 and 28 engage the shaft 70 of the key 32. Because the key is the correct key for this lock, and as a result of the arrangement of teeth 72 and notches 74, the junction between the upper portions 26A and 28A and lower portions 26B and 28B of outer and inner pins 26 and 28 are aligned with the shear line 24. In a standard lock this would normally allow the plug 14 to rotate in barrel 12. However, the upper portion 30A of pin 30 continues to straddle the shear line 24 and as a result, the plug 14 is prevented from rotating within barrel 12.

When the key 32 is fully inserted into plug 14 the contact 70 on the key engages the contact 68 on the plug. This connection between the contact 68 and 70 allows power to pass from battery 72 to the processor 60 in the plug 14. The processors 74 and 60 then communicate, via the engaged contacts 70 and 68 and determine whether the key code stored in memory 76 matches the lock code stored in memory 66. This is done by passing a code signal from processor 74 to processor 60 which checks to see if this code signal is processed to create a match with the code held on memory 66. If no match is found then no further action is taken and the pin 30 prevents rotation of the plug 14 within the barrel and the locking device 10 remains locked.

However, if a match is found, processor 60 activates linear actuator 50 which in turn will unlock the locking device 10 by the following steps. Before activation of the linear actuator 50 the lock is in the condition shown in FIGS. 3B and 4A with the locking ball 42 jammed between the plunger 56 of linear actuator 50 and engaged in the recess 40 of pin 30A. Activation of linear actuator 50 includes passing a current through the coil of electromagnet 58. This causes the permanent magnet in plunger 56 to be attracted towards the electromagnet 58 drawing it against the repulsive force of permanent magnet 54 in an upwards direction, as shown in FIG. 4A and indicated by direction D1.

Figure 4B:
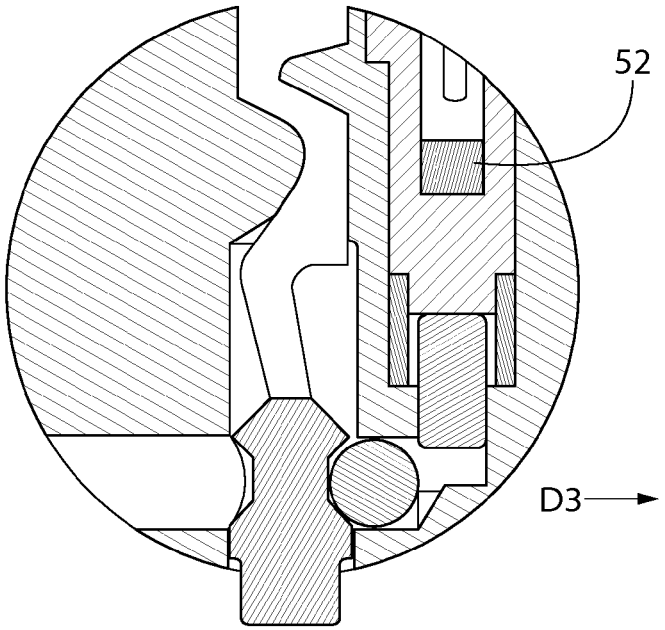
Figure 4C:
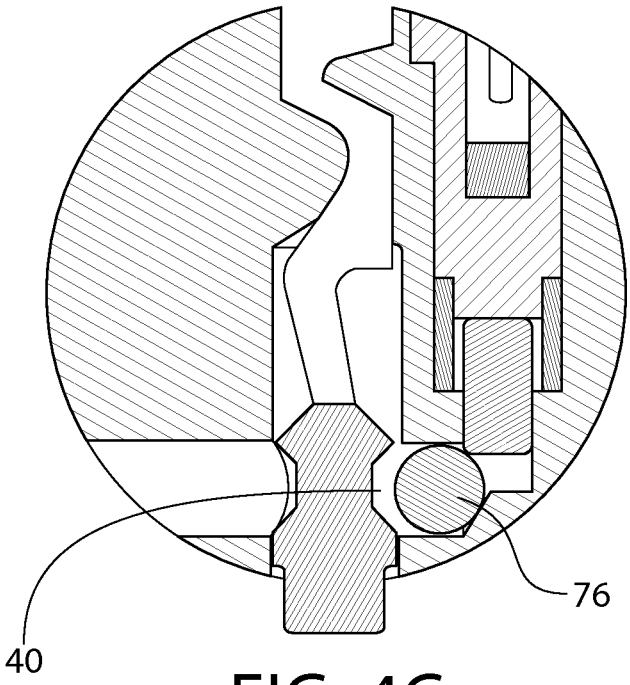
Figure 4D:
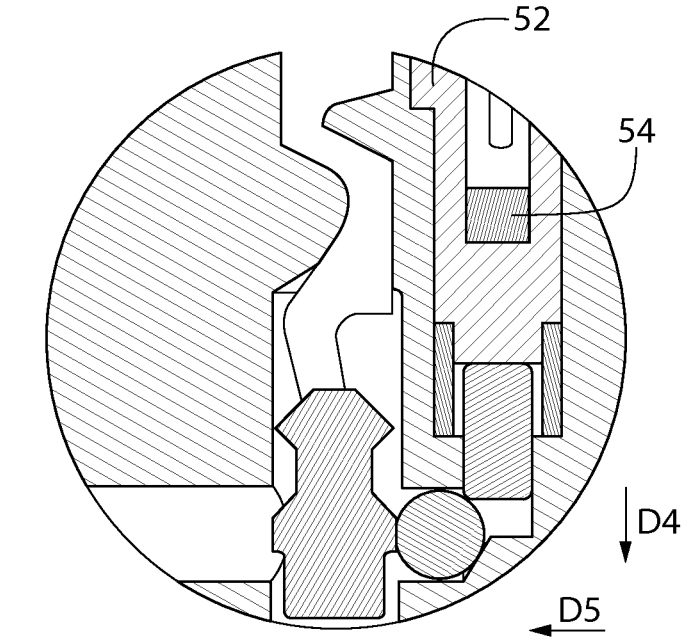
Figure 4E:
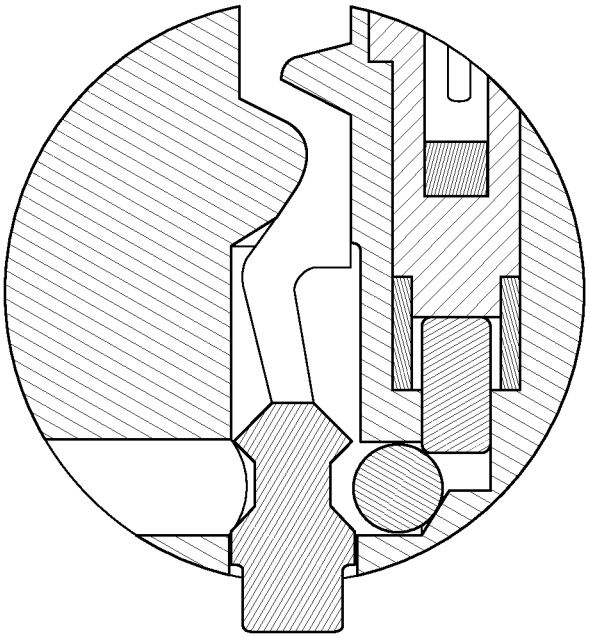
Figure 4F:
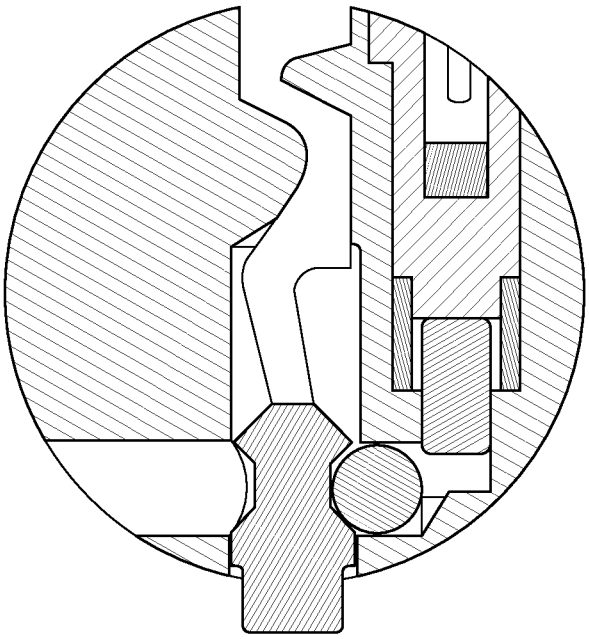

The locking device 10 is now in the condition shown in FIG. 4B where the locking ball 42 is no longer in engagement with the plunger 56 and is free to move a small distance within the working side 46 of aperture 44. Because pin 30 is biased upwards (in direction D2 which is parallel to D1) the recess 40 in pin 30, due to its part circular cross section, pushes the locking ball 42 in a direction D3 (perpendicular to D1 and D2) bringing it into engagement with an end wall 76 of working side 46 of aperture 44 and back into engagement with plunger 56 (see FIG. 4C). Because of the disengagement of the locking ball 42 from the recess 40 of the pin 30A, the biasing force of magnets 36 (arranged to repel each other) causes the pin 30A to move in direction D2 and it comes into engagement with the notch 74 in key 32 (see FIG. 3C). Because the lower part of pin 30 A is wider than the recess 40, the locking ball 42 is held in engagement with the end wall 76 (see FIG. 4D). At this point the coil of electromagnet 58 can be powered down and the like pole magnetic forces of the permanent magnet 54 and the magnet in plunger 56 will again repel one another. The plunger 56 attempts to move in direction D4 (which is opposite to D1) but is prevented from such movement because the locking ball 42 is unable to move in direction D5 (opposite to D3) due to the wider portion of pin 30A preventing it from doing so. As a result, the plunger 56 is locked in the withdrawn position without the need to draw power further from the battery 72 in key 32. Passing through the steps described above (shown in FIGS. 4B, 4C and 4D) takes a fraction of a second requiring the coil of electromagnet 58 to be drawing power from battery 72 for only a very short time.

At this time because the bottom of pin 30A is aligned with the shear line 24 the plug 14 is able to rotate in barrel 12 and a locking device 10 can be unlocked.

Figure 3D:
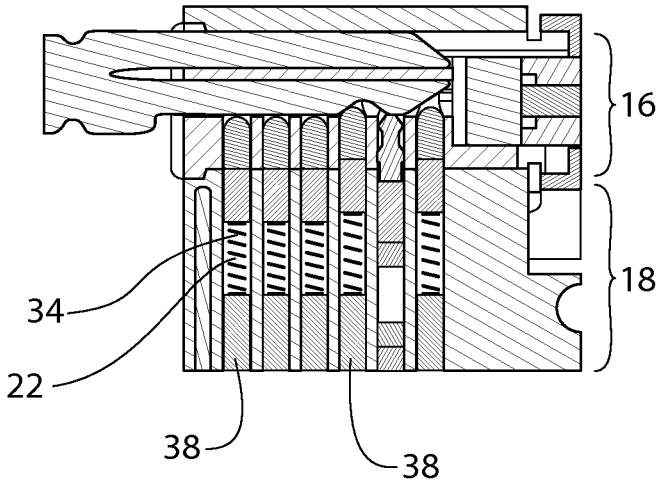
Figure 3E:
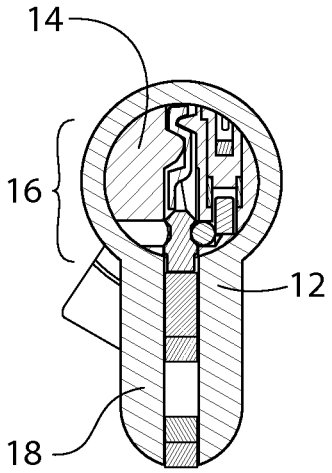
FIG. 3E is a sectional view along the line B-B of FIG. 3B.

In order to reset the linear actuator 50, locking ball 42 and pin 30A back to the locked condition (shown in FIG. 4A) it is necessary for the key to be withdrawn. To put the pin 30A back into this locking position the last tooth on the key in the direction of removal of the key from the lock (indicated at 72A) must push the pin 30A back into it starting condition. As a result, it is necessary that the tooth 72A (which is the last tooth of the key in the direction of removal of the key from the lock or the first in the direction of insertion) is larger (has a greater height in cross-section) than the tooth or notch that aligns with the pin 30A. As seen in FIG. 3D, the last tooth 72A pushes the pin 30A downwards, against the biasing force of the magnets 36, so that the recess 40 is aligned with locking ball 42 (see FIG. 4D). As a result, the locking ball 42 is able to move in direction D5 and is encouraged to do so by plunger 56 which is being pushed, by the repulsion of its magnet against permanent magnet 54, in the direction D4 (see FIG. 4F). As a result, as the key is withdrawn the last tooth 72A resets the electronically controlled locking pin 30 A and the lock is back in a condition in which only the correct manner mechanical key together with the correct electronic code will result in the locking device 10 being unlocked (FIG. 4A).

It will be appreciated by persons skilled in the art that the above embodiments have been described by way of example only and not in any limitative sense, and that various alterations and modifications are possible without departure from the scope of the protection which is defined by the appended claims. For example, the above embodiment has been described using the example of a Europrofile cylinder. However, the same invention can be equally apply to other forms of lock. The shear line as described above is linear although other arrangements of shear line are equally applicable to the present invention which generally result from other shapes of key.

The above embodiment has been described with the new pin 30 having a circular cross section and the recess being annular around the circumference of the pin. However, the pin could be formed with a different cross-section and the recess not extend around all of the pin. The locking ball 42 could be replaced with another locking member including a cylindrical or barrel shaped member. The actuator 50 described above is a linear motor. However, the apparatus would work with a solenoid which could be formed using a simple metal plug for the plunger and having a spring to bias the plunger towards the locking member, instead of the mutually repelling magnets.

In FIG. 5 the power source for both the lock and key is shown as a battery located in the key. However, other power sources and locations for the power source can be used including locating the battery in, or connected to, the locking device. The processor is shown located on the plug 14 and this helps to ensure the connection to the linear actuator 50. However, the processor could be located elsewhere and an electrical connection between the processor and the plug maintained at least whilst the locking device is in a locked condition. The lower portion 30B of pin 30 could be removed by simply using the upper of the two magnets 36 to act as that lower portion of the pin.

In the embodiment shown above the locking device contains six pin pathways and more or less pin pathways could be used. The pin 30 that contains the recess 40 is shown as the penultimate pin working from the outside of the lock to the inside. This is chosen because the last pin is required to be shorter than the pin 30 so that the last tooth 72A is longer and can reset the pin 30. This means that the pin 30 is as far away from the outside of the locking device as possible reducing the risk of tampering and outside interference. However, the invention would still work if pin 30 were located in any of the other pin pathways except the innermost pin pathway which contains the innermost pin 28.

Figure 6:
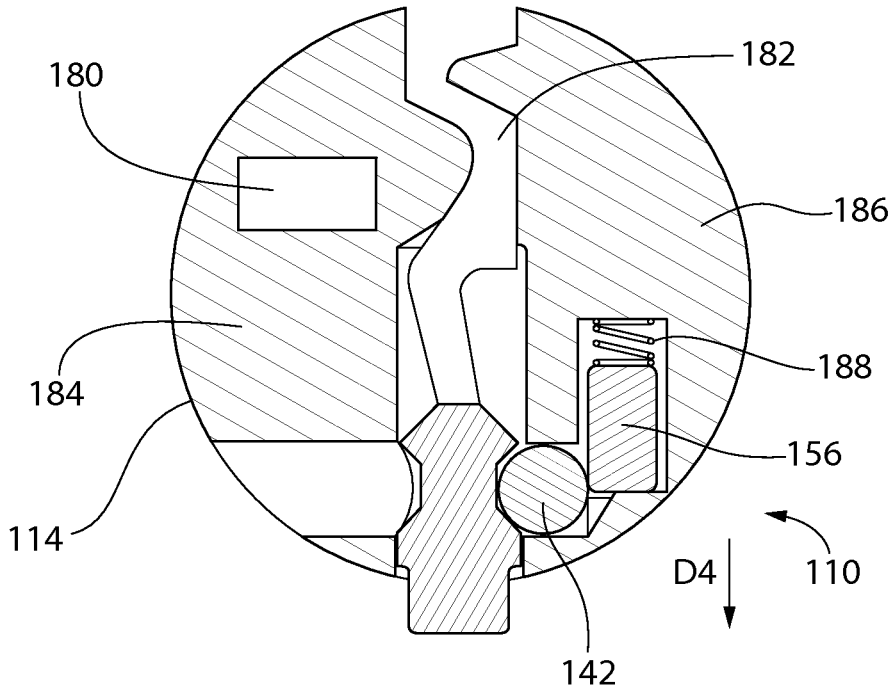
FIG. 6 is a sectional view of an alternative embodiment of a device of the present invention.
Figure 7:
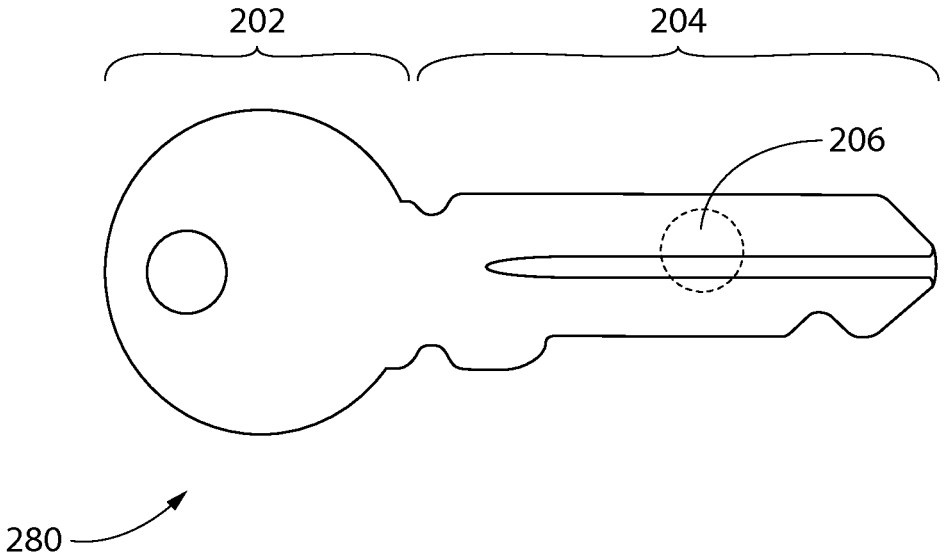
FIG. 7 is a side view of a key of the present invention for use in the lock of FIG. 6.

Referring to FIGS. 6 and 7, an alternative embodiment of the present invention is described in which like reference numerals, increased by 100, have been used to indicate features in common with the embodiments shown in FIGS. 1 to 5. The locking device 110 shown in FIG. 6 uses mechanical, and specifically magnetic, means to activate the plunger 156 to release the locking ball 142. In particular, a permanent magnet 180 is located in the plug 114 and is used to move the plunger 156. The plug 114 can be envisaged as divided into two portions by the key pathway 182, this being the hole into which the key for the locking device 110 is inserted. As a result, the two halves of the plug 114 are, as viewed in FIG. 6, a left-hand half 184 and a right-hand half 186. In the embodiment shown in FIG. 6 the permanent magnet 180 is located in the left half portion 184 of plug 114 and the plunger 156 and the locking ball 142 are located in the right half 186.

Plunger 156 is maintained in the position shown in FIG. 6 by a suitable spring 188 which pushes the plunger in the direction D4. The magnet which forms all or part of the plunger 156 is arranged to be attracted towards the permanent magnet 180 with the spring 188 resisting that magnetic attraction force. The strength of the magnet in plunger 156 and the magnet 180, together with their positions and the biasing force of the spring 188 in direction D4 are chosen so that the attractive force between the permanent magnet 180 and the magnet in plunger 156 is insufficient, when there is no key present in the key pathway 182, for the plunger 156 to move in the direction D1 and overcome the force of the spring 188.

The key 200 for use in the lock 110 is shown schematically in FIG. 7 and can be divided into a handle portion 202 and a blade portion 204. The handle portion 202 is gripped by a user when inserting the key 200 into the lock 110 and it is the blade 204 which extends into the key pathway 182 in the locking device 110. A first portion forming the majority of the key 200, and specifically the majority of the blade 204, is formed from a non-magnetic material. The term non-magnetic material is used to mean materials which are not capable of being magnetised or are only able to be magnetised very weakly and therefore cannot conduct magnetic force by acting as a flux bridge. Examples of such a substantially non-magnetic material being non-ferromagnetic materials, a non-exhaustive list of examples including brass, silver nickel alloy and austenitic steels including austenitic stainless steel, these being materials with a poor or no capacity to retain magnetic flux. The key 200 also includes a second portion, indicated at 206 which is formed as part of the blade 204 from a magnetic, but not magnetised, material. The second portion 206 acts as a flux bridge when inserted into the lock 110 and is therefore formed from a ferromagnetic material, a non-exhaustive list of which include many steels, nickel and iron, these being materials with a good capacity to retain or redirect magnetic flux. The second portion 206 is preferably formed from a material that is the same colour as the remainder of the key 200 so that it is hidden within the key. Alternatively, the second portion 206 could be formed within the volume of the key so that the outer surface of the key 200 is uniform in appearance.

When the key 200 is inserted into the locking device 110, the second portion 206 enters the key pathway 182 and when the key is fully inserted the second portion is located between the permanent magnet 180 and the plunger 156. The magnetic material in the second portion 206 acts as a flux bridge directing the magnetic flux of the permanent magnets 180 and in that of the magnet in plunger 156 thereby providing sufficient magnetic pull to overcome spring 188 and move plunger 156 in direction D1. This then releases the locking ball 142 and allows the locking device 110 to operate in the manner described previously for the locking device 10.

It should be noted that in principle the second portion 206 can be formed from a magnetised magnetic material as this would also act as a flux bridge. However, keys with magnetised portions are undesirable since they can affect other magnetic devices kept nearby, such as credit cards kept in a pocket with keys, and because they attract small amounts of magnetic material which can then be transferred into the locking device causing problems within the mechanism.

If a key formed entirely from a magnetic non-magnetised material, such as steel, is inserted into the locking device 110 the magnetic flux is distributed too widely meaning that the magnetic pull from the permanent magnet 180 is not sufficient to pull the plunger 156 in direction D1 thereby releasing the locking ball 142. If a key is inserted into the locking device 110 where the second portion (the flux bridge) 206 is too large or in the wrong place the magnetic flux is distributed in the wrong direction meaning that the magnetic pull from the permanent magnet 180 is not sufficient to pull the plunger 156 in direction D1 thereby releasing the locking ball 142.

A further variation on the invention is to use the principle of a key containing a small portion of magnetic non-magnetised material to draw a pin towards a key by acting as a flux bridge allowing a permanent magnet located on one side of the key to draw a magnetised pin on the other side of the key towards the key. For example, a pin could be arranged in a pin pathway with a spring which instead of pushing the pin towards the key pathway resists the pull of the permanent magnet on one side of the key until sufficient magnetic force is applied to the magnetic pin by the introduction of the flux bridge in the key. This is therefore working in the opposite direction to a standard pin and the pin pathway as it is not pushed away from the key pathway by the key but is instead drawn towards the key pathway by the magnetic force from the permanent magnet being directed through the flux bridge in the key.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A locking device comprising:

at least one barrel;

at least one respective plug rotatable around an axis within said barrel;

a plurality of pin pathways extending partially through said barrel and said plug at an angle transverse to said axis, the pin pathways forming a shear line where each pin pathway intersects a junction between the plug and barrel;

a plurality of pins, slidable within said pin pathways, such that when an end of each pin is aligned with the shear line, the plug is able to rotate within the barrel, wherein at least one said pin has a recess therein;

at least one locking member adapted to engage said recess; and at least one locking member control device adapted to move between a first condition in which said locking member is held in engagement with said recess thereby preventing movement of said pin and a second condition in which said locking member is released to allow movement of said locking member and said pin; and wherein the locking member is configured to move independently from the locking member control device when the locking member control device moves between the first condition and the second condition.

2. The locking device according to claim 1, wherein said locking member control device is moved from said first condition to said second condition in response to a control signal from a control processor.

3. The locking device according to claim 2, wherein said control processor creates said control signal in response to a match between a code signal held on a key and a code held in said processor.

4. The locking device according to claim 1, wherein said pins comprise first pin portions and second pin portions.

5. The locking device according to claim 1, wherein said locking member comprises a locking ball.

6. The locking device according to claim 1, wherein said locking member control device comprises an electromechanical linear actuator.

7. The locking device according to claim 6, wherein said electromechanical linear actuator comprises:

a body housing a first permanent magnet;

plunger including a second permanent magnet arranged to be repelled by said first permanent magnet, said plunger at least partially extending from said housing; and an electromagnet arranged to withdraw said second permanent magnet towards said first permanent magnet.

8. A locking device comprising:

at least one barrel;

at least one respective plug rotatable around an axis within said barrel;

a plurality of pin pathways extending partially through said barrel and said plug at an angle transverse to said axis, the pin pathways forming a shear line where each pin pathway intersects a junction between the plug and barrel;

a plurality of pins, slidable within said pin pathways, such that when an end of each pin is aligned with the shear line, the plug is able to rotate within the barrel, wherein at least one said pin has a recess therein;

at least one locking member adapted to engage said recess; and at least one locking member control device adapted to move between a first condition in which said locking member is held in engagement with said recess thereby preventing movement of said pin and a second condition in which said locking member is released to allow movement of said locking member and said pin;

wherein said locking member control device comprises a third permanent magnet and said locking member control device comprises a fourth permanent magnet located on one side of a key pathway in said plug with said locking member and locking control device located on another side of said key pathway and wherein said magnets are not sufficiently strong to move said locking control member from said first condition to said second condition when no key or a key in which a blade of the key is formed predominantly from a magnetic material is present in said key pathway but is sufficiently strong to move said locking control member from said first condition to said second condition when a key having a blade including a first blade portion formed from a substantially nonmagnetic material and a second blade portion formed from a non-magnetised magnetic material.

9. A locking system comprising:

the locking device according to claim 3; and a key comprising a blade for inserting into said plug and a transmitter for transmitting said code signal to said processor.

10. The locking system according to claim 9, wherein said key comprises a power source providing power to said locking device.

11. The locking system according to claim 9 wherein a first portion of said blade, associated with said pin with said recess, has a cross-section having a first height and a second portion of said blade, associated with another pin and preceding said first portion in a direction in which the key is inserted into the locking device, as a cross-section having a second height, said second height being greater than said first height.

12. A locking system comprising the locking device according to claim 8 and a key comprising a blade and a handle, the blade including a first blade portion formed from a nonmagnetic material and a second blade portion formed from a non-magnetised magnetic material.

13. A locking device comprising:

at least one barrel;

at least one respective plug rotatable around an axis within said barrel;

a plurality of pin pathways extending partially through said barrel and said plug at an angle transverse to said axis, the pin pathways forming a shear line where each pin pathway intersects a junction between the plug and barrel;

a plurality of pins, slidable within said pin pathways, such that when an end of each pin is aligned with the shear line, the plug is able to rotate within the barrel;

at least one locking member control device adapted to move between a first condition in which said locking member control device prevents movement of a pin or prevents movement of said plug in said barrel and a second condition in which said locking member control device allows movement of said pin or allows movement of said plug in said barrel, wherein said locking member control device comprises a first permanent magnet and said locking member control device comprises a second permanent magnet located on one side of a key pathway in said plug with said locking member and locking control device located on another side of said key pathway and wherein said magnets are not sufficiently strong to move said locking control member from said first condition to said second condition when no key or a key in which a blade of the key is formed predominantly from a magnetic material is present in said key pathway but is sufficiently strong to move said locking control member from said first condition to said second condition when a key having a blade including a first blade portion formed from a substantially nonmagnetic material and a second blade portion formed from a non-magnetised magnetic material is present in said key pathway.

14. The locking device according to claim 1, wherein the recess has a cross-sectional area along a plane that is perpendicular to a movement direction of the pin having the recess, the pin having the recess has a first region on a first side of the recess and a second region on a second side of the recess opposite the first region such that the first region and the second region bound the recess, the first region has a cross-sectional area along a plane perpendicular to the movement direction of the pin having the recess, the second region has a cross-sectional area along a plane perpendicular to the movement direction of the pin having the recess, the cross-sectional area of the recess is less than the cross-sectional area of the first region, and the cross-sectional area of the recess is less than the cross-sectional area of the second region.

15. The locking device according to claim 1, wherein the pin pathway within which the pin having the recess slides has a pathway axis, the pin having the recess moves along the pathway axis in a direction toward the axis within the barrel and a direction away from the axis within the barrel, and when the locking member engages the recess, the locking member limits the movement of the pin having the recess in the direction toward the axis within the barrel.

16. The locking device according to claim 15, wherein the locking member engages the recess, the locking member limits the movement of the pin having the recess in the direction away from the axis within the barrel.

* * * * *